United States Patent [19]

Ragnmark

[11] Patent Number: 4,609,053

[45] Date of Patent: Sep. 2, 1986

[54] HAMMER TOOL

[75] Inventor: Karl-Göran B. Ragnmark, Kalmar, Sweden

[73] Assignee: Atlas Copco Aktiebolag, Nacka, Sweden

[21] Appl. No.: 532,585

[22] Filed: Sep. 15, 1983

[30] Foreign Application Priority Data

Sep. 22, 1982 [SE] Sweden ..... 8205436

[51] Int. Cl.[4] ..... B25D 11/10

[52] U.S. Cl. ..... 173/104; 173/163; 173/109; 173/119; 173/123

[58] Field of Search ..... 173/49, 109, 114, 117, 173/123, 125, 140, 144, 145, 162 H, 122, 12, 163, 104; 192/105 BA; 403/318, 359; 81/469, 473, 476

[56] References Cited

U.S. PATENT DOCUMENTS

| | | | |
|---|---|---|---|
| 1,215,056 | 2/1917 | Pauli | 173/145 |
| 2,126,829 | 8/1938 | Snodgrass | 173/145 |
| 3,924,691 | 12/1975 | Brannstrom et al. | 173/48 |
| 3,939,921 | 2/1976 | Brannstrom | 173/121 |
| 3,968,843 | 7/1976 | Shotwell | 173/162 H |
| 4,095,654 | 6/1978 | Ross | 173/122 |
| 4,272,224 | 6/1981 | Kabele | 403/359 |
| 4,350,123 | 9/1982 | Kossek et al. | 173/163 |

*Primary Examiner*—Donald R. Schran
*Assistant Examiner*—James Wolfe
*Attorney, Agent, or Firm*—Frishauf, Holtz, Goodman & Woodward

[57] ABSTRACT

A hammer tool with a drive motor (16) and a hammer mechanism (35), the hammer mechanism including a drive piston (38) reciprocably movable in a cylinder (34) for driving a hammer piston (39) towards a working tool (13) releasably coupled to the front end of the hammer tool. The hammer tool comprises a changeable motor section (11) containing the drive motor (16) with a motor shaft (19) connected to a first part of a coupling device (50) and a hammer section (12) containing the hammer mechanism (35). The hammer mechanism comprises bevel gears (46, 47) for transmitting drive force from an input drive shaft (45) to the drive piston (38). The input drive shaft is connected to a second part of the coupling device (50) in which a flywheel (48) is incorporated. The parts of the coupling device and the flywheel are adapted to each other for providing a power transmission from the drive motor shaft (19) to the input drive shaft (45) of the hammer mechanism when the two sections (11, 12) are connected, thus enabling easy changing of the drive motor.

11 Claims, 7 Drawing Figures

HAMMER TOOL

BACKGROUND OF THE INVENTION

This invention relates to a hammer tool with a drive motor and a hammer mechanism, said hammer mechanism including a drive piston reciprocably movable in a cylinder for driving a hammer piston towards a working tool releasably coupled to the front end of the hammer tool.

Hammer tools of that kind have been heavy and often unsymmetrically loaded which have made them uneasy to handle for the operator. According to one type of prior art tool the above disadvantage is reduced by directly driving the hammer piston by the motor piston both being movable in the same cylinder but this will on the other hand bring a drill hammer which runs irregularly and has a high production cost since the drive motor parts must be specially designed to fit in the unit thus excluding the use of serially manufactured standard motors.

An object of the invention is therefore to provide a portable hammer tool which is lighter and easier to handle than prior art tools but still having the same or better performance. Another object is to provide a hammer tool which can be driven by an exchangeable drive motor manufactured separately from the hammer mechanism. A further object is to provide a hammer tool which can be driven by interchangeable drive motors of different kind e.g. of combustion, electric or hydraulic kind.

It is still another object to provide a hammer tool which is compact and well silenced and matches all safety regulations set up for different motor alternatives.

These objects and others are achieved by providing a portable hammer tool according to the accompanying claims.

DETAILED DESCRIPTION

Figure 1:
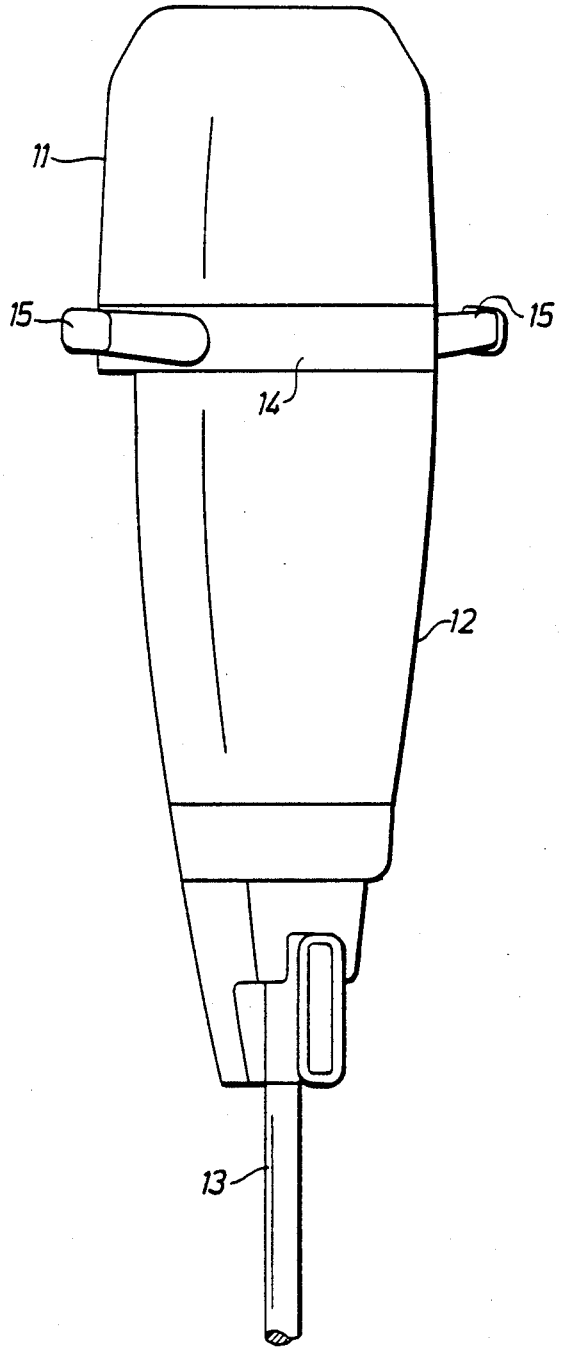
FIG. 1 is a side view of a hammer tool according to the present invention.

The hand-held hammer tool shown in FIG. 1 comprises an upper motor section 11 and a lower hammer section 12 to which front end a working tool 13 e.g. a drilling rod 13 is releasable coupled. The hammer section 12 includes an annular support 14 for handles 15 mounted thereon.

Figure 2:
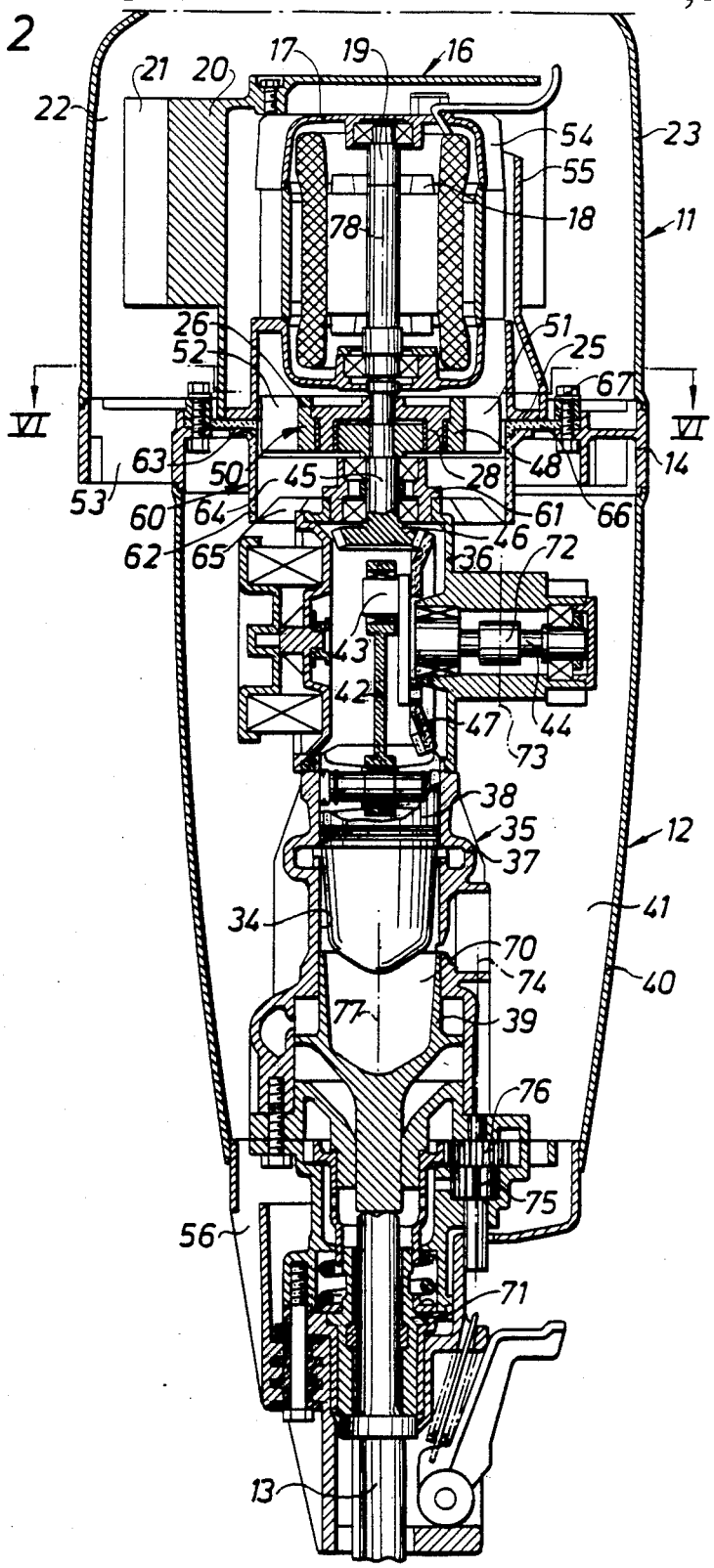
FIG. 2 is a longitudinal cross section through the hammer tool according to FIG. 1.
Figure 6:
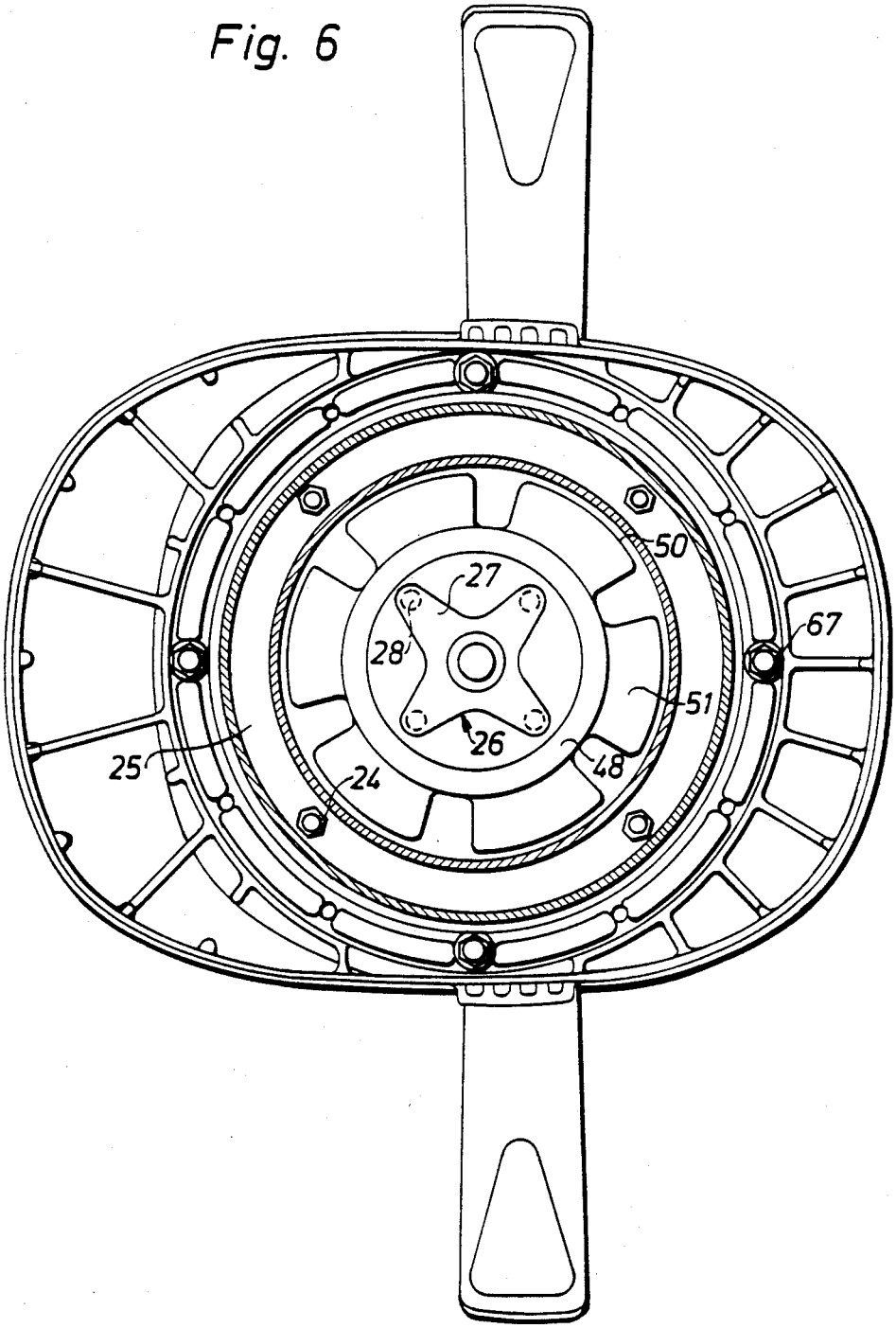
FIG. 6 is a cross section taken along the line 6—6 in FIG. 2.

The motor section 11 according to FIG. 2 comprises an electric drive motor 16 with a housing 17 and an anchor 18 mounted on a motor shaft 19. The motor is a 4-pole AC asynchronous motor without brushes of the squirrel cage type. An electronic converter 20 for frequency transference and power control of the motor is attached to the motor housing 17. The converter 20 comprises cooling flanges 21 located within an air stream space 22 between the motor housing 17 and an outer cover 23. The motor section 11 is mounted to the hammer section by means of four bolts 24, see FIG. 6, through an annular flange 25 on the motor housing 17. A claw shaped member 26 is attached to the end of the motor shaft 19. The member 26 comprises four arms 27 with a circular pin 28 extending from each one. The pins 28 are provided with a layer 29 of suitable plastic material for preventing metallic contact between the two sections 11, 12.

Figure 3:
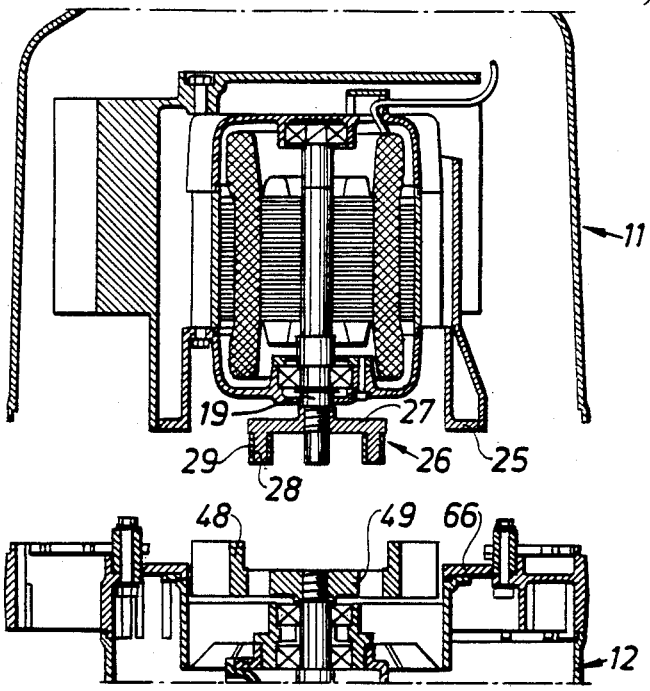
FIG. 3 is the same cross section as FIG. 2 but shown with the motor section disconnected from the hammer section.

The hammer section 12 comprises a hammer mechanism 35 with a crank housing 36 and a cylinder housing 37 receiving in a cylinder 34 a reciprocating drive piston 38 and a hammer piston 39. Said housings are surrounded by a cover 40 leaving an open space 41 for a cooling air stream. The connecting rod 42 of the drive piston 38 is journalled on a crank pin 43 incorporated in a crank shaft 44. Said crank shaft 44 is driven by an input drive shaft 45 by means of a first 46 and a second 47 bevel gear mounted on the end of the input drive shaft 45 and on the crank shaft 44 respectively which shafts are perpendicular to each other. Said second bevel gear 47 is made of a suitable plastic material for preventing electrical transmission through the gearing. A flywheel 48 is mounted on the other end of the input drive shaft 45 and comprises four holes 49, see FIG. 3, for receiving the claw shaped member 26 therein thus making the second member of a claw coupling 50 for transmitting drive force from the motor to the hammer mechanism when the sections 11, 12 are connected. Along the periphery, the flywheel 48 is provided with fan blades 51 which constitutes a fan 52 for cooling both the electric motor and the hammer mechanism. The cooling air stream is led into the space 22 in the motor cover 23 through an opening 53 in the support 14 and is then conveyed along the converter 20 to an entrance 54 in a closure wall 55 surrounding the motor housing 17 and from there along the housing, through the fan 52, along the shank and cylinder housings 36, 37 out through openings 56 disposed at the front end of the hammer tool.

The input drive shaft 45 is journalled within a non-metallic shaft housing 60 associated with the crank housing 36. The shaft housing 60 comprises an inner tube shaped member 61, an outer annular member 62 with a flange 63 and radially extending rods 64 therebetween leaving a passage 65 for the cooling air stream. The flange 63 is adapted for receiving the bolts 24 which connects the two sections 11, 12. An annular non-metallic membrane 66 preferably of rubber material is laid between the two meeting flanges 25 and 63. The membrane 66 provides for a non-metallic vibration damping connection between the two sections 11, 12 as well as between the motor and hammer houses 17, 36, 37, 60 and the annular support 14 for the handles 15 which support 14 is attached to the membrane 66 by bolts 67. Since the claw coupling 50 also has a layer of non-metallic material the electric motor is electrically insulated from the rest of the hammer tool. Said insulation is furthermore secured by the non-metallic bevel gear 47 and shaft housing 60.

The hammer mechanism, apart from the bevel gears arrangement, is of a kind previously known e.g. in U.S.

Pat. Nos. 3,924,691 and 3,939,921 and will therefore be described only briefly. The drive piston 38 thus drives the hammer piston 39 against the drill rod 13 or another working tool via a compressed air cushion in a working chamber 70 between said pistons. A rotary mechanism for transferring rotation from the crank shaft 44 to a drill sleeve 71 comprises a schematically shown clutch unit 72, an outgoing axle therefrom, indicated by the axis 73 and 74, and a toothed wheel 75 which cooperates with teeth 76 on the drill sleeve 71.

The longitudinal axis 77 of the hammer mechanism is aligned with the rotary axis 78 of the motor shaft 19 which provides for a light construction with its center of gravity located in alignment with the working tool 13. The general design of the hammer tool is adapted to enable an easy exchange of the drive motor, and in FIG. 3 there is shown how the two sections 11, 12 are divided which is done only by unscrewing the bolts 24 after which the motor housing and the claw pins 28 can be withdrawn.

Figure 4:
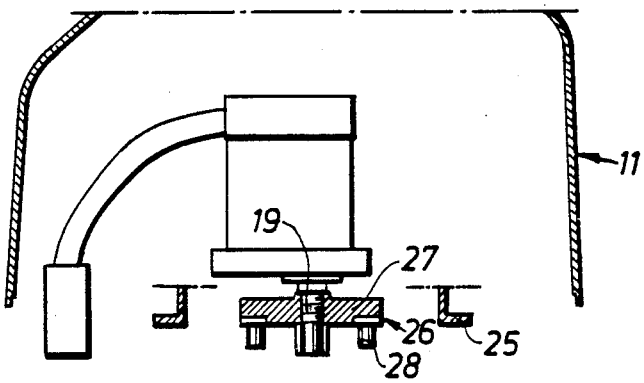
FIG. 4 and FIG. 5 longitudinal cross sections of alternative motor sections connectable to the hammer mechanism according to FIG. 2.
Figure 5:
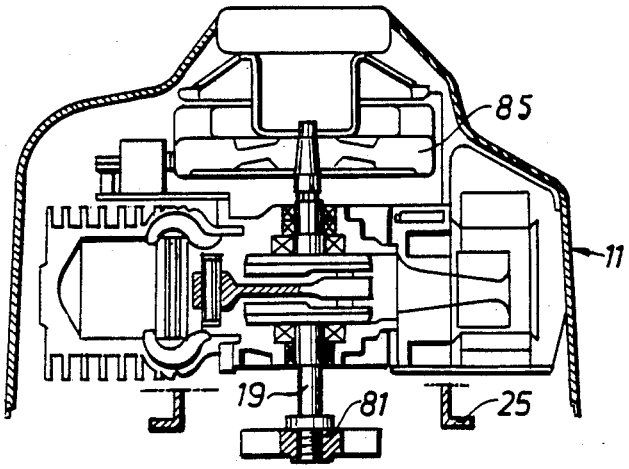
Figure 7:
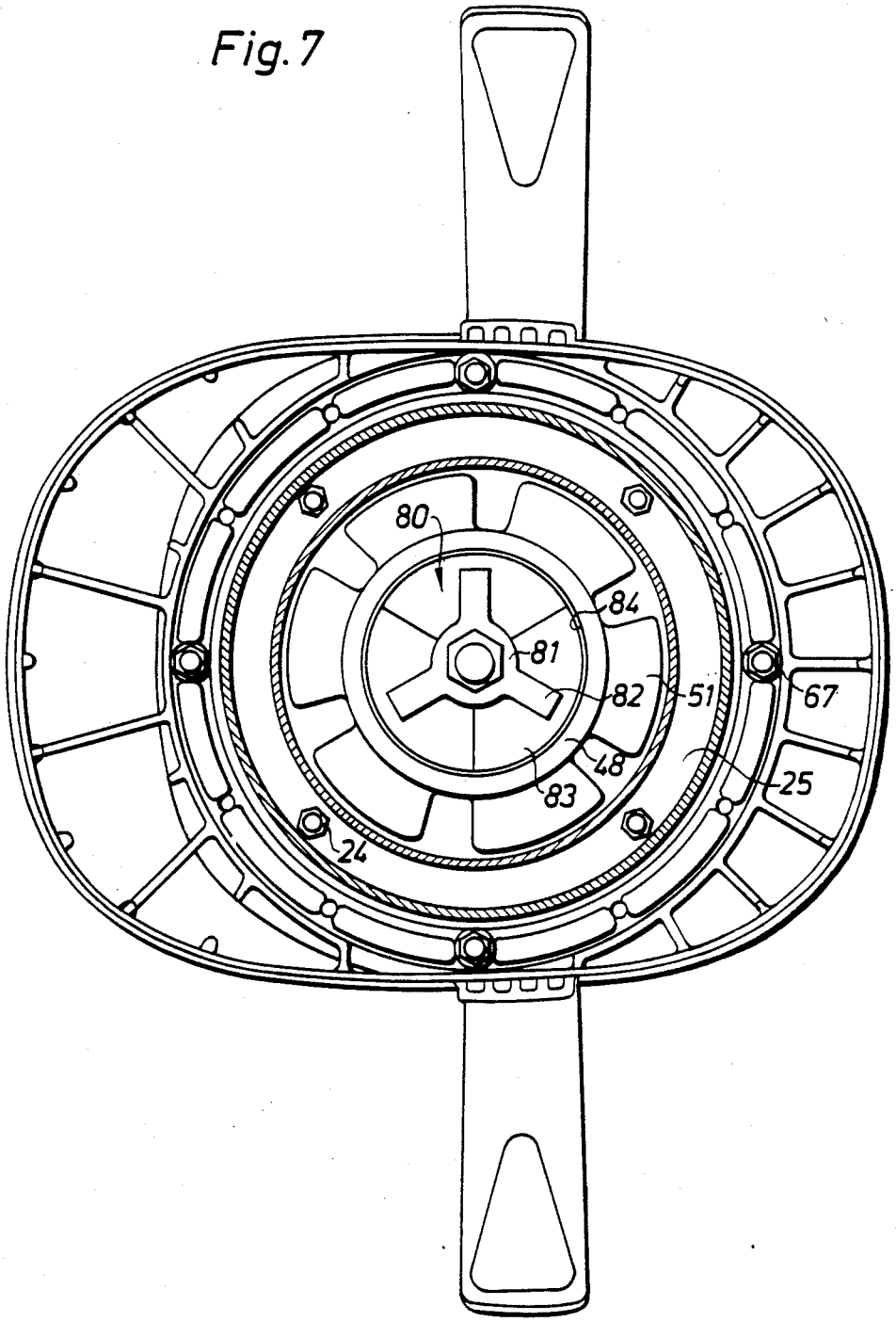
FIG. 7 is a cross section taken by the same way as line 6—6 in FIG. 2 showing the connection between the combustion motor alternative according to FIG. 5 and the hammer mechanism.

Instead of electric motors also other motor alternatives can be used together with the same hammer section e.g. an hydraulic motor, or a combustion motor. The hydraulic motor, shown in FIG. 4, comprises thus the same claw coupling member 27 and connecting flanges 25 as the electric motor. The combustion motor shown in FIG. 5 has also the same connecting flanges 25 but the coupling means comprises a centrifugal clutch 80 to enable the motor to work on idle speed when the hammer mechanism is not in use. The clutch 80, see FIG. 7, includes a hub 81 with three radially extending flanges 82 for guiding weights 83 located in a friction drum 84 incorporated in the flywheel 48. When the motor shaft 19 rotates the weights 83 during idle speed the centrifugal power acting on the weights will not be sufficient for achieving a friction grip between the weights and the drum 84, but when the speed is increased said friction grip is established and the hammer mechanism starts to work. To provide for a sufficient cooling of the motor when it runs on idle speed a second fan 85 (FIG. 5) is mounted to the motor shaft 19. As appears from above the flywheel must be changed when using the combustion motor alternative.

The described possibility to change the drive motor offers several advantages e.g. low manufacturing costs since the same hammer section can be used for all motor alternatives meaning longer production series both for the hammer mechanism and drive motors which preferably are chosen among the standard production of motor manufacturers. Another advantage is the possibility to easily exchange the first drive motor to another one of the same or different kind.

The invention is of cause not limited to the described example but can be varied in many ways within the scope of the accompanying claims.

I claim:

1. A hand held hammer tool comprising:

a drive motor (16);

a hammer mechanism (35) including a hammer piston (39), and a drive piston (38) reciprocably movable in a hammer cylinder (34) for driving said hammer piston (39) by means of an intermediate air cushion (70) towards a working tool (13) which is releasably coupled to the front end of the hammer tool, said hammer cylinder (34) having an axis (77);

a motor section (11) including said drive motor (16), which motor section is readily interchangeable as a unit in said hammer tool, said drive motor having a shaft (19) having an axis (78) which is substantially aligned with the axis (77) of said hammer cylinder (34);

coupling means (50) including a first part (27, 81) and a second part (49);

said first part (27, 81) of said coupling means (50) being incorporated in said motor section (11) and said motor shaft (19) of said drive motor (16) being connected to said first part (27, 81) of said coupling means (50);

a hammer section (12) including said hammer mechanism (35), said hammer section further comprising a rotatably driven input drive shaft (45) substantially aligned with the axis (77) of said hammer cylinder (34), said second part (49) of said coupling means (50) connected to said input drive shaft (45) for driving thereof, bevel gears (46, 47) coupled to said input drive shaft (45) and crank means between said bevel gears (46, 47) and said drive piston of said hammer mechanism for transmitting a drive force from said rotatably driven input drive shaft (45) to said drive piston (38);

means (24) for selectively and removably connecting said motor section (11) to said hammer section (12) such that said first and second parts of said coupling means (50) engage each other; and a flywheel (48) in said hammer section (12), incorporating said second part (49) of said coupling means (50) and thereby being mounted on said input drive shaft (45) and constrained to remain in said hammer section (12) when said motor section (11) is disconnected from said hammer section (12), said coupling parts (27, 81; 49) being adapted to each other for providing power transmission from said drive motor (16) through said input drive shaft (45), gears (46, 47) and crank means to said hammer mechanism when said motor section (11) and hammer section (12) are connected together while at the same time driving said flywheel (48) at the same speed as said input drive shaft (45), said flywheel (48) being adapted to make more uniform, over the revolution cycle of said crank means, a rotary load on said input drive shaft when said hammer mechanism is in operation and thereby to facilitate the operation of said hammer tool with a variety of interchangeable motor sections in which different kinds of motors may be installed.

2. The hammer tool of claim 1, wherein said flywheel (48) includes a fan (52) for cooling said hammer mechanism (35) and for at least partly cooling said drive motor (16).

3. The hammer tool of claim 2, wherein said first part (27) of said coupling means (50) comprises a claw shaped member (26) coupled to said drive motor shaft (19); and said second part (49) of said coupling means (50) comprises a claw receiving member (49) incorporated in said flywheel (48) for engagingly receiving said claw shaped member (26).

4. The hammer tool of claim 1, wherein said coupling means (50) comprises a centrifugal clutch (80), said first part of said coupling means (50) including expanding means (83) coupled to said drive motor shaft (19), and said second part of said coupling means (50) including a friction drum (84) incorporated in said flywheel (48) for engagingly receiving said expanding means (83).

5. The hammer tool of claim 1, wherein said motor section (11) is surrounded by an outer motor section cover (23); and said hammer section (12) is surrounded by an outer hammer section cover (40); and further comprising a resilient membrane clamped to said outer covers (23, 40) in such a way as to be clamped between said motor section and said hammer section annularly around said coupling means so as to elastically suspend said drive motor (16) and said hammer mechanism (35) in said outer covers (23, 40).

6. The hammer tool of claim 5, wherein said outer covers include handle means (15) which is grippable by an operator.

7. The hammer tool of claim 1, comprising an annular resilient membrane (66) clamped between said motor section and said hammer section annularly around said coupling means and further mounted on an annular support (14) forming part of said hammer section (12) and carrying handles (15) for manipulation of the hammer tool, whereby to elastically suspend said drive motor (16) and said hammer mechanism (35) from said handles (15).

8. A hand-held tool comprising:

a hammer section (12) including a hammer mechanism (35), said hammer mechanism (35) comprising a hammer piston (39); a drive piston (38) reciprocably movable in a hammer cylinder (34) for driving said hammer piston (39) by an intermediate air cushion (70) towards a working tool (13) which is releasably coupled to the front end of the hammer section; a rotatably driven input drive shaft (45); a first coupling means (49) coupled to said input drive shaft (45); a flywheel (48) on said input drive shaft (45); said hammer cylinder (34), drive shaft, first coupling means and flywheel having a common axis; and means for transmitting a drive force from said rotatably driven input drive shaft (45) to said drive piston (38) and for converting the rotary force of said input drive shaft into reciprocating force applied to said piston (38); said flywheel remaining in said hammer section when said hammer section is disconnected from the remainder of said hand-held tool;

a motor section (11) releasably connectable to said hammer section (12) and interchangeable as a unit which is removable from said hammer section (12), said motor section including a drive motor (16) having a motor shaft (19) which is substantially aligned with the axis (77) of said hammer cylinder (34) when said motor section is connected with said hammer section; and a second coupling means (27,81) coupled to said motor shaft (19) of said drive motor (16) for engaging said first coupling means (49) of said hammer section (12);

said hammer section (12) further including a hammer section cover (40);

said motor section (11) further including a motor section cover (23);

means (24) for selectively and removably connecting said motor section cover (23) to said hammer section cover (40) such that said motor section (11) and said hammer section (12) are integrally and operatively coupled together, such that said first coupling means (49) of said hammer section (12) and said second coupling means (27, 81) of said motor section (11) are engageably coupled to each other so as to supply drive power from said drive motor (16) to said input drive shaft (45) of said hammer section (12); and an annular membrane (66) clamped to said outer covers (23, 40) and between said motor section (12) and said hammer section (12) so as to elastically suspend said motor (16) and said hammer mechanism (35) within said outer covers (23, 40), thereby serving as a vibration damping means between said motor and hammer sections (16, 35) and said outer covers (23, 40) and the portions of said motor and hammer sections (11, 12) within said covers, while permitting, by release of the clamping of said membrane, the disconnection of said motor section (11) as a unit from said hammer section (12).

9. The hammer tool of claim 8, wherein said hammer section (12) includes an annular support (14) which carries a pair of handles (15) for gripping by an operator, said annular membrane (66) and said covers (40, 23) being coupled to said support means (14).

10. The hammer tool of claim 9, wherein said support means (14) comprises an annular support (14) carrying at least one handle (15) of the hammer tool.

11. A hand held hammer tool comprising:

a hammer section (12) including an input drive shaft (45) connected to drive means (38) for a hammer body (39) reciprocable in said hammer section (12) for actuating a working tool (13) which is releasably coupled to the front end of the hammer section (12);

a motor section (11) including a combustion motor (16) having a motor shaft and, affixed on said motor shaft, a first part (27, 81) of releaseable coupling means (50);

a second part (49) of said coupling means (50) mounted on said input drive shaft (45) in said hammer section (12);

means (24) for connecting and disconnecting said motor section (11) as a unit to and from said unit (12) in such a manner that said first and second parts of said coupling means engage each other when said sections are connected together, for facilitating interchange of said motor section or another motor section of a different interchangeable model;

a first fan (85) on said motor shaft (19) for combustion motor; and a second fan, including a flywheel (48), mounted in said hammer section (12) on said input drive shaft (45) thereof and thereby constrained to remain in said hammer section (12) when said motor section (11) is disconnected from said hammer section (12).

* * * * *